US007389820B2

(12) United States Patent
Day

(10) Patent No.: US 7,389,820 B2
(45) Date of Patent: Jun. 24, 2008

(54) BLOWOUT PREVENTER POSITIONING SYSTEM

(75) Inventor: Mark A. Day, Alberta (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 139 days.

(21) Appl. No.: 11/290,952

(22) Filed: Nov. 30, 2005

(65) Prior Publication Data

US 2007/0119596 A1 May 31, 2007

(51) Int. Cl.
*E21B 19/00* (2006.01)

(52) U.S. Cl. ..... 166/379; 166/85.4

(58) Field of Classification Search ..... 166/379, 166/382, 79.1, 85.4; 299/72
See application file for complete search history.

(56) References Cited

U.S. PATENT DOCUMENTS 4,230,372 A * 10/1980 Marten ..... 299/39.3
5,121,793 A * 6/1992 Busch et al. ..... 166/79.1
5,590,867 A 1/1997 Van Winkle
6,209,652 B1 4/2001 Portman et al.
6,502,641 B1 1/2003 Carriere
6,902,007 B1 * 6/2005 Orr et al. ..... 166/379
7,040,411 B2 * 5/2006 Kainer et al. ..... 166/379
2002/0029907 A1 3/2002 Carriere et al.
2005/0178586 A1 8/2005 Livingstone
2005/0211430 A1 9/2005 Patton et al.
2005/0247456 A1 11/2005 Wise et al.
2006/0260844 A1 * 11/2006 Patton et al. ..... 175/52

* cited by examiner

*Primary Examiner*—William P Neuder
(74) *Attorney, Agent, or Firm*—Michael Flynn; David Cate; Robin Nava

(57) ABSTRACT

An embodiment of a blowout preventer system of the present invention includes a mast functionally connected a frame assembly and a carriage functionally connected to the mast. The carriage is adapted to carry and support a blowout preventer in a manner such that the blowout preventer may be moved along an angular path and along a plurality of linear paths. The system may further include a mechanism for rotating the blowout preventer along a first rotational path. The system may further include a mechanism for rotating the blowout preventer along a second rotational path.

15 Claims, 2 Drawing Sheets

BLOWOUT PREVENTER POSITIONING SYSTEM

FIELD OF THE INVENTION

The present invention relates in general to subterranean wells and more specifically to a system for positioning and supporting a blowout preventer in relation to a wellhead.

BACKGROUND

In order to workover a well it is necessary and/or required to connect a blowout preventer to the wellhead. In the case of wellheads that are not plumb the process is more cumbersome and time consuming and often requires supporting the blowout preventer once installed. A current method of positioning the blowout preventer relative to the wellhead is through the use of multiple cranes. This method provides only modest positive support for the blowout preventer to reduce excessive loads placed on the wellhead. This method further does not facilitate articulation of the blowout preventer relative to the wellhead which can result in damage to the wellhead.

Therefore, it is a desire to provide a blowout preventer system that provides the ability to position a blowout preventer for connection to and disconnection from a wellhead. It is a still further desire to provide a blowout preventer system that provides positive support to the blowout preventer reducing the load on the wellhead.

SUMMARY OF THE INVENTION

Accordingly, a blowout preventer system and method for providing positive support to a blowout preventer and to align and position a blowout preventer for connection to or disconnection from a wellhead is provided. An embodiment of a blowout preventer system of the present invention includes a mast functionally connected to a frame assembly and a carriage functionally connected to the mast. The carriage is adapted to carry and support a blowout preventer in a manner such that the blowout preventer may be moved along an angular path and along a plurality of linear paths. The system may further include a mechanism for rotating the blowout preventer along a first rotational path. The system may further include a mechanism for rotating the blowout preventer along a second rotational path.

An embodiment of a method of positioning and supporting a blowout preventer relative to a wellhead includes the steps of setting a positioning assembly proximate a wellhead, connecting a blowout preventer to the positioning assembly, actuating the positioning assembly such that the blowout preventer is substantially aligned along the longitudinal axis of the wellhead, leveling the blowout preventer with the wellhead and connecting the blowout preventer with the wellhead.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
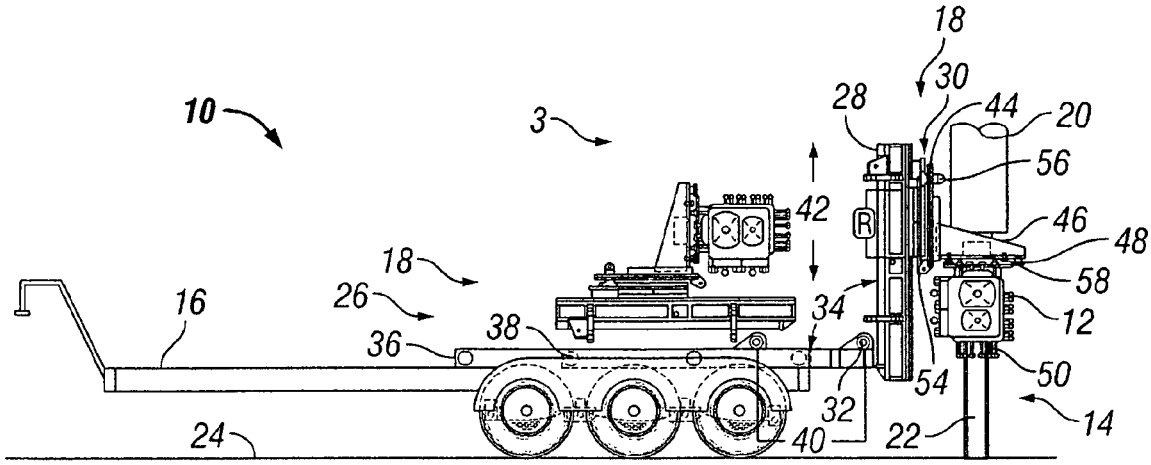
FIG. 1 is a side view of an embodiment of a blowout preventer (BOP) system of the present invention.

Refer now to the drawings wherein depicted elements are not necessarily shown to scale and wherein like or similar elements are designated by the same reference numeral through the several views.

FIG. 1 is a side view of an embodiment of a blowout preventer (BOP) positioning and support system of the present invention, generally denoted by the numeral 10. BOP system 10 provides a mechanism for manipulating and supporting a BOP 12 in relation to a wellhead 14.

BOP system 10 includes a support assembly 16 and a positioning assembly 18. Support system 18 is illustrated as a trailer, however it should be realized that other support systems may be utilized such as, but not limited to, motorized vehicles or skids. FIG. 1 illustrates positioning system 18 in a traveling position denoted by the numeral 3 and a working position denoted by the numeral 5. Working position 5 illustrates BOP 12 connected between wellhead 14 and a conduit 20 such that the longitudinal axis of BOP 12 and conduit 20 are substantially aligned with longitudinal axis 22 of wellhead 14.

As is well known, the longitudinal axis 22 of wellhead 14 is often not perpendicular to ground level 24 whether by design as in a slant well (FIG. 4) or by happenstance. System 10 of the present invention facilitates the connection and disconnection of BOP 12 with wellhead 14 regardless of the angular position of wellhead 14. System 10 further provides support to BOP 12 while operations are being conducted through BOP 12.

Positioning assembly 18 includes a frame assembly 26, a mast 28 and a carriage 30 in functional connection with one another. Mast 28 is pivotally connected to frame assembly 26 via connection 32. Connection 32 facilitates angular movement and positioning of mast 18, thus BOP 12, along the angular path 34. Angular path 34 desirably extends at least 0 to 95 degrees, wherein 0 degrees is substantially parallel with support assembly 16.

Figure 2:
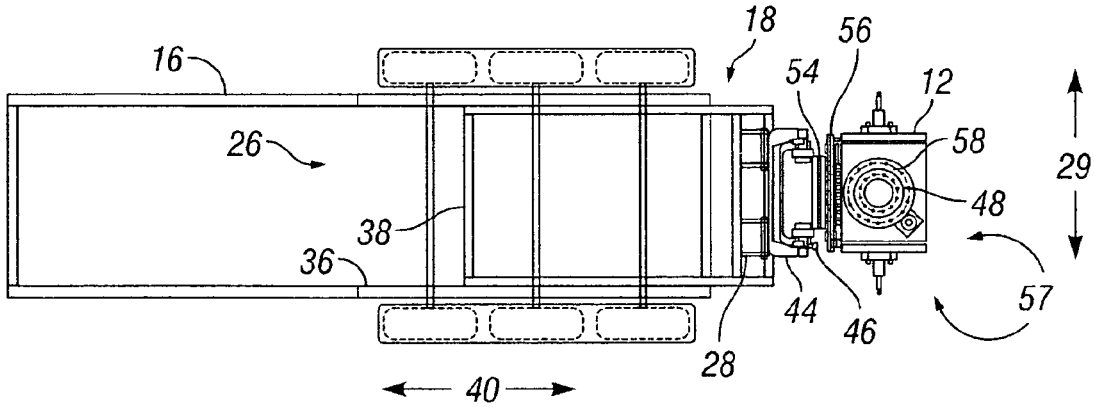
FIG. 2 is top view of an embodiment of a BOP positioning system.

As illustrated in FIGS. 1 and 2, frame assembly 26 includes a first frame section 36 and a second frame section 38. Frame sections 36, 38 are telescopically connected to provide linear longitudinal movement and positioning of mast 28 along path 40. This linear longitudinal movement facilitates positioning of BOP 12 fore and aft relative to wellhead 14.

Carriage 30 and BOP 12 are also moveable along the lateral path 29 shown in FIG. 2. Mast 28 may be moveably connected laterally to frame assembly 26. It may be desired for carriage 30 to be moveably connected to mast 28 in a manner to provide the lateral movement of BOP 12 along path 29.

Carriage 30 is connected to mast 28 in a manner to be moveable along a portion of the length of mast 28 indicated at 42 by the arrow. Linear movement of carriage 30 along path 42 is referred to as linear vertical movement herein.

Figure 3:
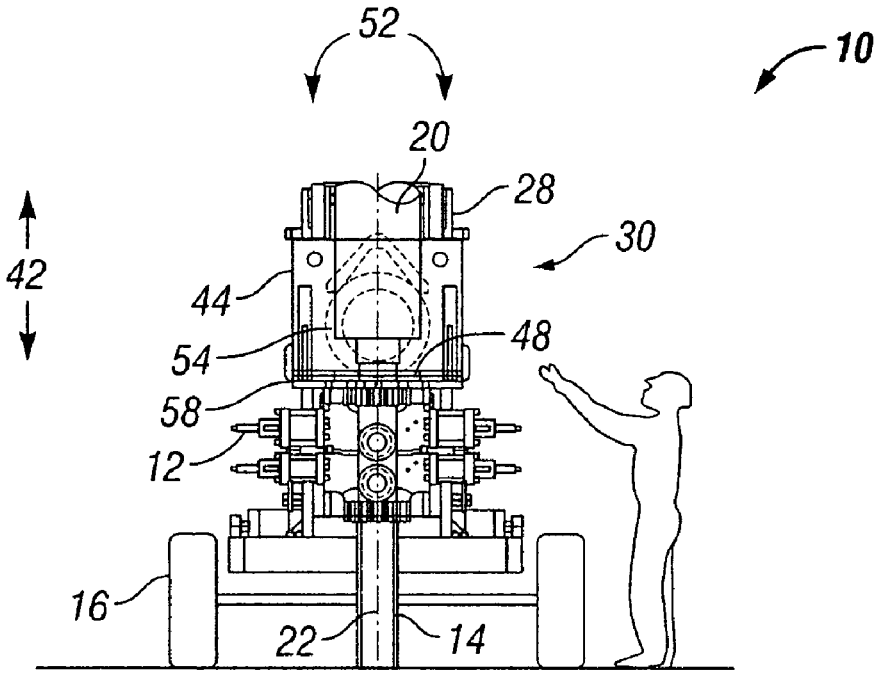
FIG. 3 is a front view of an embodiment of a BOP positioning system.
Figure 4:
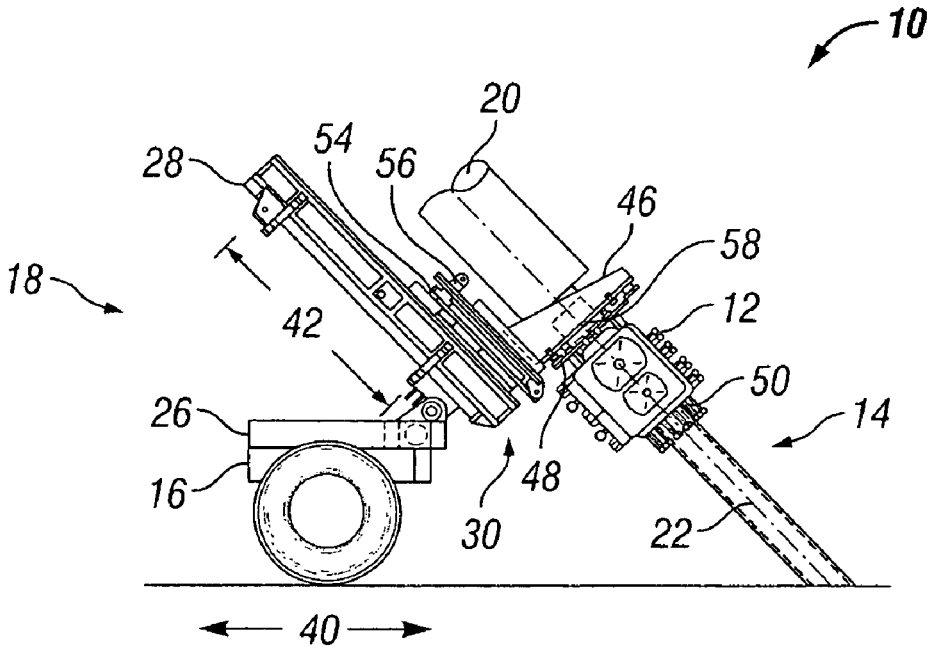
FIG. 4 is a side view of an embodiment of a BOP positioning system relative to a slant well installation.

Carriage 30 includes a first portion 44 and a second portion 46. First portion 44 is substantially parallel to mast 28 and second portion 46 extends substantially perpendicular to first portion 44. Desirably second portion 46 is adapted for fixedly connecting BOP 12 thereto. For example, as shown in FIG. 2 carriage 30 includes a flange assembly 48 adapted for connecting BOP 12 thereto and for connecting conduit 20 (FIGS. 1, 3 and 4). In the illustrated example of flange assembly 48, BOP 12 and conduit 20 are connected by bolts, however, threaded connections may be used.

As previously described, BOP 12 is moveable along an angular path 34 and a plurality of linear paths 29, 40, 42. These movements facilitate positioning of BOP 12 along the longitudinal axis 22 of wellhead 14. However, as is well known in the art, wellheads are seldom aligned parallel or perpendicular to ground 24. Thus, it is often necessary to articulate BOP 12 so as to be parallel, or level, with the mating flange 50 of wellhead 14. To level BOP 12 with wellhead 14 it may be necessary to articulate BOP 12 along a arcuate path 52 (FIG. 3) and/or along angular path 34 (FIG. 1) which is substantially perpendicular to path 52.

Articulating or rotational movement of carriage 30 and BOP 12 along arcuate path 52 is referred to herein as "vertical" rotational movement or articulation. Vertical articulation 52 is provided by a drive mechanism 54 connected between carriage portions 44 and 46. Drive mechanism 54 may be connected between carriage 30 and mast 28. Vertical drive mechanism 54 is illustrated as a ring gear, but other rotational mechanisms may be utilized.

Referring back to FIG. 1, angular movement of mast 28 along angular path 34 facilitates alignment of BOP 12 with the longitudinal axis 22 of wellhead 14. Movement along path 34 may also be utilized to level BOP 12 with wellhead 14. This leveling movement is substantially perpendicular to the leveling movement provided by mechanism 54 along path 52. BOP system 10 may further include a second angular moving mechanism 56 connected to carriage 30 to fine tune the positioning of BOP 12, and level BOP 12 with wellhead 14. Second angular moving mechanism 56 moves BOP 12 along angular path 34.

Often it is further necessary to rotate BOP 12 in a plane to align the connecting flange's bores for bolted connection of BOP 12 and wellhead 14. Referring again to FIG. 2, BOP system 10 provides for rotating BOP 12 in a plane indicated by the arrow 57. Horizontal rotation 57 is provided by a horizontal drive mechanism 58. Drive mechanism 58 is illustrated as a ring gear, but other rotational mechanisms may be utilized. Horizontal drive mechanism 58 is illustrated connecting flange assembly 48 and carriage 30.

Operation of an embodiment of BOP system 10 is described with reference to FIGS. 1 through 4. BOP 12 is transported in traveling position 3 on support assembly 16 to a well site and positioned proximate wellhead 14. BOP 12 may be connected to positioning assembly 18 at the wellsite. BOP 12 is moved longitudinally away from support 16 toward wellhead 12. Carriage 30 and BOP 12 are moved vertically along mast 28 such that BOP 12 clears wellhead 14. Mast 28 is articulated angularly along path 34 and BOP 12 is moved laterally along path 29 such that BOP 12 is substantially aligned along longitudinal axis 22 of wellhead 14. Positioning of BOP 12 may then be fine tuned for connecting BOP 12 to wellhead 14. Manipulating vertical drive mechanism 54 facilitates leveling BOP 12 with wellhead 14 along an axis as illustrated by the path 52. BOP 12 may be further leveled with wellhead 14 along path 34 via hinge connection 32 and second angular positioning mechanism 56. Finally, BOP 12 may be rotated in the horizontal plane 57 via drive mechanism 58 to facilitate connecting BOP 12 and wellhead 14.

Various mechanisms may be provided within the system as illustrated herein to provide movement of carriage 30 and carried BOP 12 along the longitudinal, lateral, vertical, angular, vertical rotational, and horizontally rotational paths. Specific movement mechanisms, including the various interconnecting elements and drive mechanisms, for travel along the paths are not shown in detail as they are well known in the art. Such movement mechanism may include without limitation, hydraulic actuators, pneumatic actuators, electric motors, screw drives, ring gears, belt and chain drives and may be manually powered. BOP system 10 provides positive support of BOP 12 as well as facilitating the placement of BOP 12.

From the foregoing detailed description of specific embodiments of the invention, it should be apparent that a system for positioning and supporting a blow out preventer relative to a wellhead that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A BOP system for positioning and supporting a BOP relative to a wellhead, the system comprising:

a mast functionally connected to a frame assembly;

a carriage functionally connected to the mast;

a vertical rotational drive mechanism in functional connection with the carriage for moving the BOP along a substantially arcuate path, and a second angular positioning mechanism functionally connected to the carriage for providing further movement along an angular path, wherein the carriage is adapted to carry and support a BOP in a manner such that the BOP may be moved along the angular path, along a plurality of linear paths, and along the arcuate path.

2. The system of claim 1, wherein the vertical rotational drive mechanism comprises a ring gear.

3. The system of claim 1, further including a horizontal rotational drive mechanism in functional connection with the carriage for moving the BOP along a substantially arcuate path.

4. The system of claim 3, wherein the horizontal rotational drive mechanism comprises a ring gear.

5. The system of claim 1, further comprising a support assembly connected to the frame assembly.

6. The system of claim 1, further including a flange assembly connected to the carriage, the flange assembly adapted for interconnecting the BOP and a conduit.

7. The system of claim 1, further comprising a support assembly connected to the frame assembly.

8. The system of claim 7, further comprising a second angular positioning mechanism functionally connected to the carriage for providing further movement along the angular path.

9. The system of claim 7, further including a flange assembly connected to the carriage, the flange assembly adapted for interconnecting the BOP and a conduit.

10. The system of claim 8, further including a flange assembly connected to the carriage, the flange assembly adapted for interconnecting the BOP and a conduit.

11. The system of claim 5, further including a flange assembly connected to the carriage, the flange assembly adapted for interconnecting the BOP and a conduit.

12. The system of claim 3, further comprising a support assembly connected to the frame assembly.

13. The system of claim 12, further comprising a second angular positioning mechanism functionally connected to the carriage for providing further movement along the angular path.

14. A BOP system for positioning and supporting a BOP relative to a wellhead, the system comprising:

a mast functionally connected to a frame assembly;

a carriage functionally connected to the mast;

a vertical rotational drive mechanism in functional connection with the carriage for moving the BOP along a substantially arcuate path;

a support assembly connected to the frame assembly; and a second angular positioning mechanism functionally connected to the carriage for providing further movement along an angular path, wherein the carriage is adapted to carry and support a BOP in a manner such that the BOP may be moved along the angular path, along a plurality of linear paths, and along the arcuate path.

15. A BOP system for positioning and supporting a BOP relative to a wellhead, the system comprising:

a mast functionally connected to a frame assembly;

a carriage functionally connected to the mast;

a vertical rotational drive mechanism in functional connection with the carriage for moving the BOP along a substantially arcuate path, a horizontal rotational drive mechanism in functional connection with the carriage for moving the BOP along a substantially arcuate path; and a second angular positioning mechanism functionally connected to the carriage for providing further movement along an angular path, wherein the carriage is adapted to carry and support a BOP in a manner such that the BOP may be moved along the angular path, along a plurality of linear paths, and along the arcuate path.

* * * * *